United States Patent [19]

Butt et al.

[11] Patent Number: 4,666,343

[45] Date of Patent: May 19, 1987

[54] PROTECTIVE CONSTRUCTION FOR A PLATFORM INSTALLED IN THE OPEN SEA AGAINST THE IMPACT OF FLOATING OBJECTS

[75] Inventors: Heinz G. Butt, Pinneberg; Michael Vogt, Hamburg, both of Fed. Rep. of Germany

[73] Assignee: Bilfinger + Berger Bauaktiengesellschaft, Mannheim, Fed. Rep. of Germany

[21] Appl. No.: 858,724

[22] Filed: May 2, 1986

[30] Foreign Application Priority Data

May 13, 1985 [CA] Canada ..... 481429

[51] Int. Cl.[4] ..... E02B 17/00

[52] U.S. Cl. ..... 405/217; 405/61; 405/211

[58] Field of Search ..... 405/217, 211, 61, 195, 405/203, 204; 267/182; 404/6

[56] References Cited

U.S. PATENT DOCUMENTS

| | | | |
|---|---|---|---|
| 4,245,929 | 1/1981 | Pearce et al. | 405/211 |
| 4,325,655 | 4/1982 | Jahns et al. | 405/217 |
| 4,425,055 | 1/1984 | Tiedemann | 405/217 |
| 4,470,724 | 9/1984 | Pollack | 405/211 |
| 4,479,742 | 10/1984 | Bruce | 405/211 X |

FOREIGN PATENT DOCUMENTS

| | | | |
|---|---|---|---|
| 2028403 | 3/1980 | United Kingdom | 405/203 |

OTHER PUBLICATIONS

Ocean Industry, Dec. 1982, p. 87, Chain Star Platform.

Gerwick et al., "Development of a Structural Concept . . . "; May 7–9, 1984, OTC 4799.

"The Hibernia Development" article.

*Primary Examiner*—Cornelius J. Husar

*Assistant Examiner*—Todd G. Williams

*Attorney, Agent, or Firm*—Nixon & Vanderhye

[57] ABSTRACT

A protective device protects a platform installed in the open sea against the impact of floating objects such as icebergs, ice formations, or ships. A massive protective body surrounds the platform to be protected and has a bottom with inclined bearing surfaces. The body is movably supported on large bearings having inclined bearing areas that slidingly engage the bearing surfaces. When the protective body is struck by a floating object the kinetic energy of the impact pushes the protective body upwards on a portion of the inclined bearing areas and is transformed into potential energy of the elevated body. The protective body is able to thrust the floating object away from the platform as the body moves downwardly to its original position as its potential energy is reconverted to kinetic energy.

20 Claims, 5 Drawing Figures

FIG. 4
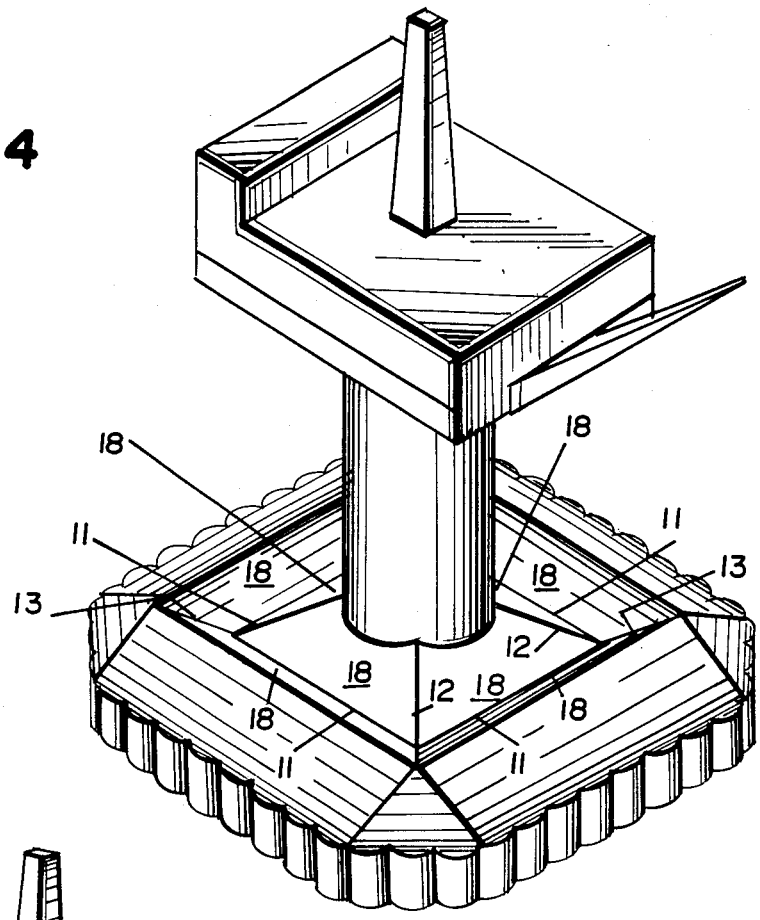
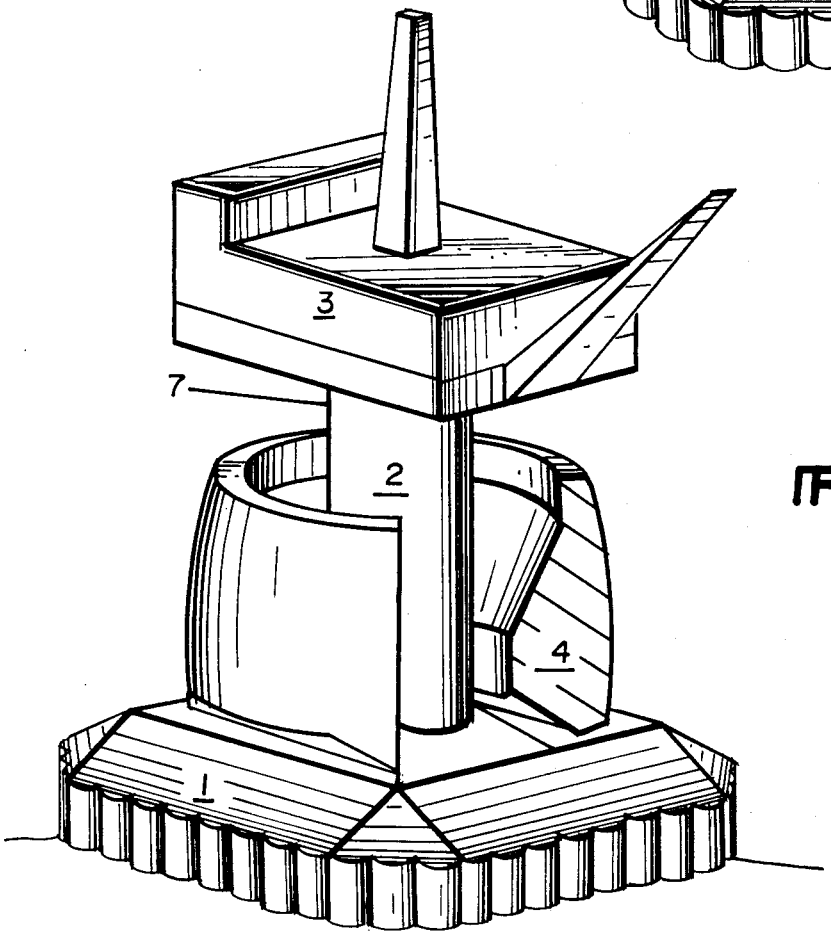
FIG. 5

PROTECTIVE CONSTRUCTION FOR A PLATFORM INSTALLED IN THE OPEN SEA AGAINST THE IMPACT OF FLOATING OBJECTS

BACKGROUND AND SUMMARY OF THE INVENTION

This invention relates to protective devices for a structure installed in a large body of water, such as a drilling and production platform installed in the open sea.

Large drilling and production platforms are known and used at the present time to either explore for oil or gas or to recover oil or gas from a known hydrocarbon producing structure. One form of these platforms is the type that is supported on the sea bed and is held in place by its own weight. Because these structures are located in the open sea they are subject to the hazards of this environment including the possibility of being struck by large floating objects such as vessels or ships or, depending on the area where the platform is located, icebergs or ice flows. The possibility of being struck by a large floating object is particularly great when bad weather conditions prevail, which conditions may cause heavy seas. Because many people may live and work on a large drilling platform, it is recognized that steps must be taken to protect this personnel from the serious danger for loss of life or grave injury if the platform should be struck by a large floating object.

Protective devices for platforms installed in the open sea have been proposed in the past and are known. According to these known devices, the kinetic energy of an iceberg impact is absorbed by means of frictional forces generated between the surfaces of a foundation and the underlaying surface of a protective body. A significant disadvantage of these known devices is that after displacement e.g. by an iceberg impact the protective body must be lifted up by deballasting and brought to a target position by winches or other suitable mechanical equipment. Subsequently, the protective body has to be put into its initial position by ballasting. To perform its protective function it is necessary that the upper edge of the protective body, which is in an idle position, extend above the level of the water.

Another solution proposed and known is a design which takes the huge loads affecting the platform by an impact by respective masses of the structure.

The present invention provides an improved protective compliant device for a structure, such as a platform, installed offshore which device has a protective body that helps prevent dangerous impacts from floating objects such as icebergs or ships by thrusting the latter aside and away from the structure. In addition to preventing an impact between the floating object and the structure, the protective body is able to slide back on its own to its initial position without any mechanical auxiliary equipment. The preferred protective device disclosed herein surrounds the structure on all sides and thus is able to protect the structure from a floating object approaching the structure from any direction.

According to one aspect of the present invention, a protective device for a structure installed in a large body of water includes a massive protective body capable of surrounding the structure to be protected and having a bottom with at least one inclined bearing surface. There are also bearing means for slidably supporting the protective body and these bearing means have at least one inclined bearing area adapted to engage slidingly the bearing surface. In addition, foundation means support the bearing means. When the protective device is struck by a floating object, the kinetic energy of the impact pushes the protective body upwards on the at least one bearing area from an initial position to an elevated position, and the kinetic energy is transformed into potential energy of the elevated body. The protective body with its received potential energy is capable of sliding back to its initial position after the impact and of thereby keeping the floating object away from the structure.

According to a further aspect of the invention, a protective device for a structure installed in a body of water includes a protective body capable of surrounding the structure to be protected and having a bottom with inclined bearing surfaces. Bearing means having inclined bearing areas adapted to engage sliding the bearing surfaces movably support the protective body.

Further features and advantages will become apparent from the following detailed description when considered in conjunction with the accompanying drawings.

BRIEF DESCRIPTION OF THE DRAWINGS

FIG. 4 is an isometric view of the platform without the protective body which illustrates the bearing area on the foundation; and FIG. 5 is an isometric view of the platform with a 90° outcut of the protective body illustrating the effect of an impact on the protective device.

DETAILED DESCRIPTION OF THE INVENTION

Figure 1:
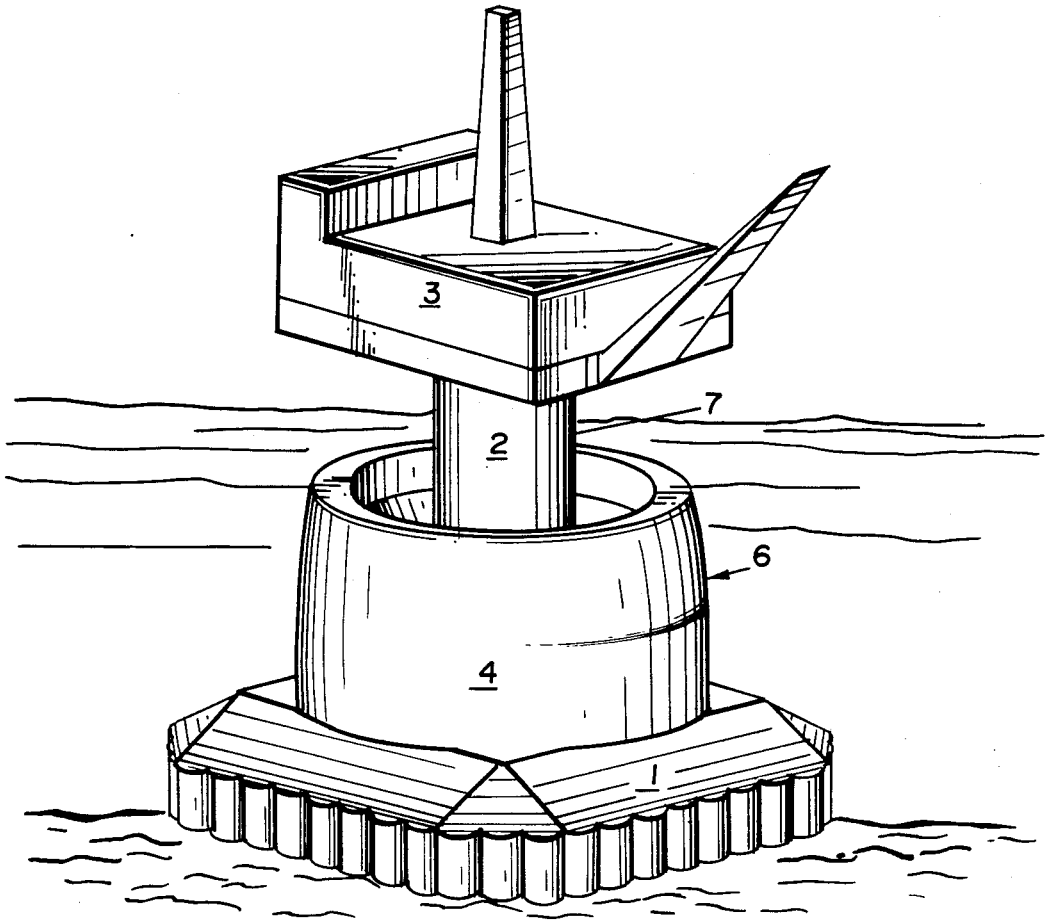
FIG. 1 is an isometric view of the side elevation of a platform arranged in the sea and protected by a protective device constructed in accordance with the invention.
Figure 2:
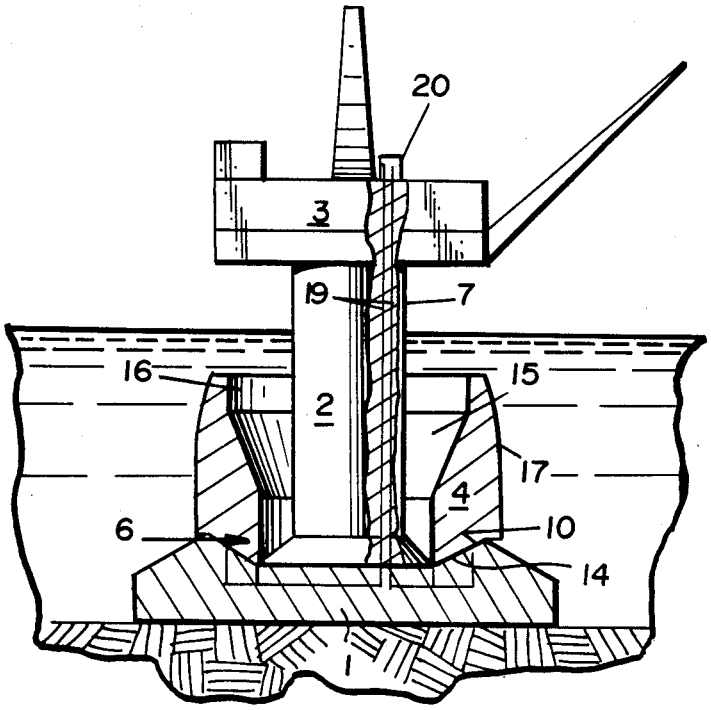
FIG. 2 is a side view, partly in cross-section and partly in elevation, of the platform and the protective device of FIG. 1.

FIGS. 1 and 2 show a protective device 6 for a structure 7 installed in a body of water. Typically the structure is a large drilling or production platform for the recovery of hydrocarbon from the sea. The illustrated structure includes a deck 3 positioned well above the surface 8 of the water. The deck is mounted on top of a large column 2 which in some structures may comprise a number of separate columns. The bottom of the column 2 is connected to a large foundation 1 that rests on the sea bed 9 and is preferably made of concrete. The illustrated structure 7 is one that is held in place by its own weight, that is by gravity. It will be appreciated by those skilled in the art that FIGS. 1 and 2 merely illustrate one possible form of platform structure. Such structures can vary in their design depending upon operational requirements.

The protective device 6 includes a massive protective body 4 capable of surrounding the structure to be protected and having a bottom with at least one inclined bearing surface 10, and preferably a plurality of bearing surfaces. In the embodiment of FIGS. 1 to 5 the bearing surfaces are distributed on a square at the bottom of the protective body. Each side of the square has two inclined bearing surfaces which meet at a line 14. The surfaces of each side are equal in size and at the same inclination to the horizontal. The bearing surfaces of the protective body 4 arranged in a square constitute the main component of the bearing.

In the center of the protective body 4 is an opening 15 through which the column 2 passes. The opening 15 must be sufficiently large that even if the protective body is displaced sideways to its maximum extent, it will not damage or impact on the column 2. In the illustrated embodiment the protective body has a relatively wide open area 16 above the opening 15. The protective body 4 is dimensioned so that the top thereof is below the surface 8 of the water when the protective device is installed around the platform. The preferred construction material for the body 4 is concrete. The protective body 4 should be of the lowest possible diameter and dead weight. The weight of the body 4 can be optimized by alteration of the properties of the bearing surfaces with respect to the angle of inclination of the bearing surfaces and coefficient of friction thereof.

In the illustrated embodiment, the outer wall 17 is slightly inclined upwardly on its upper part, and inwardly at a steep angle to the horizontal. Alternatively, the outer wall can have a staggered or stepped design. The design of the gradation and/or inclinations of the outer wall 17 is determined by the water depth at the location as well as by such factors as the shape, dimensions and the weight of the floating objects which could case the impact.

The protective body 4 is movably supported by bearing means which, in the embodiment of FIGS. 1 to 5, comprises a plurality of bearing areas 18 disposed in a square configuration which is incorporated in the foundation 1 and is preferably made of concrete. The surfaces of the bearing areas 18 may be plated with tiles. The bearing areas are the main component of the bearing means. In the illustrated embodiment there are four sides of the bearing means and each side has two inclined bearing areas 18 associated therewith which meet at a line 11, which is the apex of a triangle when viewed from the end, as in FIG. 3. In the idle or initial position of the protective body, as shown in FIG. 2, the lowest line of the bearing surfaces 10 is located at the aforementioned line 11. The outermost (from column 2) set of bearing areas 18 have valleys 13 at the intersections thereof, while the innermost set of areas 18 have an arris 12 at each intersection thereof.

In the embodiment illustrated in the drawings, the areas 18 are generally trapezoidal in shape and define generally triangular prism-shaped areas therebetween; however various other configurations for the bearing areas 18 are possible. For instance, they may have or define the shape of obelisks, multi-sided pyramids, combined three-sided prisms, and multi-sided ramps. Each set of bearing areas 18 should preferably have the same dimensions with components of one having a uniform relationship to components of the others. Moreover, the bearing areas 18 on the bearing devices, as well as the bearing surfaces 10, are preferably clad with a low friction coefficient material.

It will thus be seen that in the illustrated embodiment the upper surface of the foundation 1 is formed with triangular recesses in a square to accommodate and hold the bearing surfaces 10 of the protective body 4. Suitable lubricants, such as grease, can also be provided between the engaging bearing surfaces 10 and bearing areas 18. For instance, the lines 19 in FIG. 2 illustrate pipes for this lubricant. These pipes 19 are connected to a pumping system 20 located on the deck 3.

Figure 3:
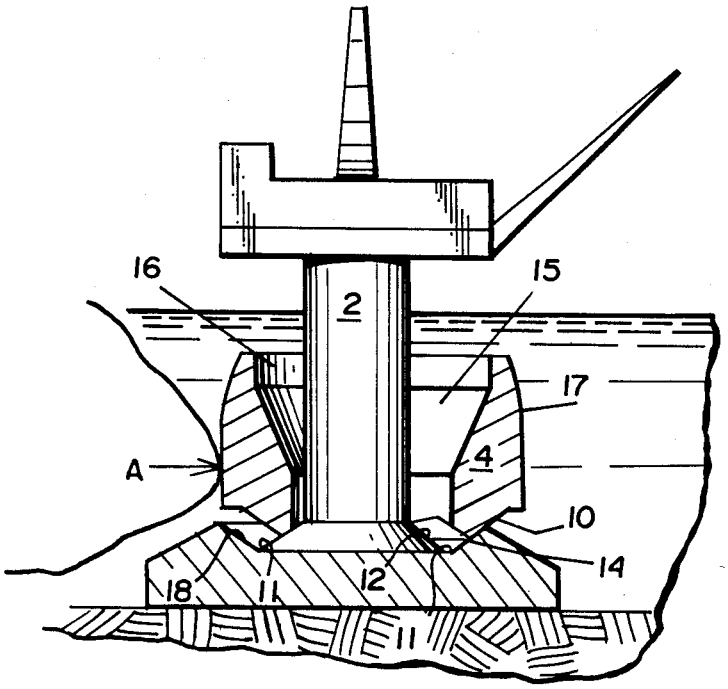
FIG. 3 is a view similar to FIG. 2 but illustrating the effect of an impact on the protective device.

The operation of the protective device 6 will now be explained with reference to FIGS. 3 and 5 which show what occurs upon a direct impact. The arrow A indicates the point of impact on the body 4. The protective body 4 is pushed upwardly on four of the bearing areas 18, as surfaces 10 slide with respect to areas 18, guided by the arrises 12 and the diametric valleys 13. This results in the kinetic energy from the impact of the floating object being transformed into potential energy as the protective body 4 is elevated. When all of the kinetic energy has been transformed into potential energy and dissipated by frictional forces, the protective body will cease to rise and will slide back to its initial position, thereby keeping the floating object away from the structure 7. It will be seen from FIGS. 3 and 5 that there is no need for mechanical auxiliary equipment in order to return the protective body to its initial or idle position on the bearing means.

Preferably the massive protective body 4 is made of reinforced concrete and it should have sufficient weight that the maximum possible kinetic energy from a potential impact on the body will be completely converted to potential energy or otherwise dissipated before the protective body reaches its maximum displacement. The preferred protective body 4 surrounds the structure 14 on all sides (as illustrated) in order that the structure will be protected from a floating object approaching from any direction.

Because the upper surface of the protective body is disposed below the water level, free access to the platform for supply ships is provided. The present construction also results in wave forces which might affect the structure being reduced. The protective device also has the advantage that the floating object tends to be pushed away from the endangered structure when the protective body slides back to its initial position.

It will be apparent to those skilled in the art that various modifications and changes can be made to the protective devices described herein without departing from the spirit and scope of this invention. All such modifications and changes as fall within the scope of the appended claims are intended to be part of this invention.

What is claimed is:

1. A protective device for a structure installed in a large body of water comprising:

a massive protective body disposed exteriorly of the structure to be protected and having a bottom with at least one inclined bearing surface;

bearing means for slidably supporting said protective body, said bearing means having at least one inclined bearing area for slidingly engaging said bearing surface; and foundation means for supporting said bearing means;

said bearing surface and said bearing area being constructed and cooperating so that when said protective body is impacted by a floating object, the kinetic energy of the impact causes said protective body to move upwardly from an initial position to an elevated position, with said bearing surface and bearing area engaging each other during the upward movement, so that the kinetic energy is transferred into potential energy of the elevated protective body and so that said protective body with its received potential energy is able to slide back to its initial position after the impact of the floating object thereby keep the floating object away from the structure.

2. A device as recited in claim 1 wherein said protective body surrounds the structure on all sides thereof.

3. A device as recited in claim 2 further comprising a plurality of bearing areas and a plurality of bearing surfaces.

4. A device as recited in claim 3 wherein said bearing means comprises four sets of inclined bearing areas disposed in a square, with each set of bearing areas comprising two bearing areas that intersect at a line which is at the lowermost position of the bearing areas, and wherein the bearing areas of each set intersect the bearing areas of adjacent sets along arrises or valleys.

5. A device as recited in claim 4 wherein each of said bearing areas is generally trapezoidal in shape.

6. Apparatus as recited in claim 5 wherein said protective body is made of reinforced concrete.

7. A device as recited in claim 6 wherein said bearing surfaces on said protective body and said bearing areas on said bearing means are clad with a material having a low coefficient of friction.

8. A device as recited in claim 7 wherein said bearing areas and said bearing surfaces are clad with tile.

9. A device as recited in claim 3 further comprising means for providing a lubricant to reduce the friction between said bearing areas and said bearing surfaces.

10. A device as recited in claim 9 wherein said structure comprises a platform with a deck above water, and wherein said means for providing a lubricant is mounted on said deck.

11. A device as recited in claim 3 wherein said protective body has an outer wall that is shaped and dimensioned so as to have a generally tapered configuration which is determined by the depth of water at the location at which the protective device is utilized, and the shape, dimensions, and weight of floating objects which might impact thereon.

12. A device as recited in claim 11 wherein the outer wall of said protective body is inclined.

13. A device as recited in claim 11 wherein the protective body is mounted so that the top thereof is below the surface of the body of water at the structure.

14. A device as recited in claim 1 wherein the protective body is mounted so that the top thereof is below the surface of the body of water at the structure.

15. Apparatus as recited in claim 1 wherein said protective body is made of reinforced concrete.

16. A device as recited in claim 1 wherein said protective body has an outer wall that is shaped and dimensioned so as to have a generally tapered configuration which is determined by the depth of water at the location at which the protective device is utilized, and the shape, dimensions, and weight of floating objects which might impact thereon.

17. An offshore apparatus, disposed in a large body of water having a surface, and comprising:

a platform supported in the body of water and having a column and a deck supported by the column, the deck being above the surface of the body of water;

a massive protective body disposed exteriorly of and surrounding the column on all sides thereof:

the protective body having a bottom with inclined bearing surfaces;

bearing means for slidably supporting said protective body, said bearing means having a plurality of bearing areas for slidingly engaging said bearing surfaces; and foundation means for supporting said bearing surfaces adjacent but exteriorly of the column supporting said deck so that said bearing surfaces and said bearing areas cooperate to cause the protective body to move upwardly from an initial position to an elevated position with the bearing surfaces and bearing areas engaging each other when the protective body is impacted by a floating object, the kinetic energy of the floating object being transformed into potential energy of the elevated protective body, so that the protective body with its received potential energy is able to slide back to its initial position after the impact to thereby keep the floating object away from the structure; and said foundation means supporting said bearing means with said protective body thereon so that the uppermost portion of said protective body is disposed below the surface of the water.

18. Apparatus as recited in claim 17 further comprising lubricant providing means mounted on said deck and for providing a lubricant to the area between said bearing areas and said bearing surfaces to reduce the friction therebetween.

19. A device as recited in claim 17 wherein said protective body has an outer wall that is shaped and dimensioned so as to have a generally tapered configuration which is determined by the depth of water at the location at which the protective device is utilized, and the shape, dimensions, and weight of floating objects which might impact thereon.

20. Apparatus as recited in claim 17 wherein said protective body is made of reinforced concrete.

* * * * *